US011220395B2

(12) United States Patent
Goodrich

(10) Patent No.: US 11,220,395 B2
(45) Date of Patent: Jan. 11, 2022

(54) SLIT PAPER EXPANSION METHOD AND APPARATUS

(71) Applicant: David Paul Goodrich, Newtown, CT (US)

(72) Inventor: David Paul Goodrich, Newtown, CT (US)

( * ) Notice: Subject to any disclaimer, the term of this patent is extended or adjusted under 35 U.S.C. 154(b) by 357 days.

(21) Appl. No.: 15/820,514

(22) Filed: Nov. 22, 2017

(65) Prior Publication Data

US 2018/0127197 A1 May 10, 2018

Related U.S. Application Data

(63) Continuation-in-part of application No. 15/001,168, filed on Jan. 19, 2016, now abandoned.

(60) Provisional application No. 62/571,382, filed on Oct. 12, 2017, provisional application No. 62/425,200, filed on Nov. 22, 2016.

(51) Int. Cl.

| | |
|---|---|
| ***B65D 85/672*** | (2006.01) |
| ***B65D 65/40*** | (2006.01) |
| ***B65B 41/12*** | (2006.01) |
| ***B65D 5/10*** | (2006.01) |
| ***B65B 11/00*** | (2006.01) |
| ***B65D 5/42*** | (2006.01) |
| ***B65D 5/00*** | (2006.01) |

(52) U.S. Cl.

CPC ..... *B65D 85/672* (2013.01); *B65B 11/004* (2013.01); *B65B 41/12* (2013.01); *B65D 5/001* (2013.01); *B65D 5/106* (2013.01); *B65D 5/4266* (2013.01); *B65D 65/403* (2013.01)

(58) Field of Classification Search

CPC .... B65D 85/672; B65D 5/001; B65D 5/4266; B65D 5/106; B65D 65/403; B65D 85/66; B65D 85/67; B65B 11/004; B65B 41/12

USPC ..... 242/160.1, 588.4, 588.6; 53/409; 206/389, 415, 521, 521.4, 395, 396, 413, 206/416

See application file for complete search history.

(56) References Cited

U.S. PATENT DOCUMENTS

| | | | | |
|---|---|---|---|---|
| 152,636 A * | 6/1874 | Heyl | ..... | B65D 5/106 229/158 |
| 225,189 A * | 3/1880 | Wenzel | ..... | B65D 5/106 229/158 |
| 227,916 A * | 5/1880 | Munson | ..... | B65D 5/106 229/158 |
| 246,813 A * | 9/1881 | Pickell | ..... | B65D 5/106 229/158 |
| 285,706 A * | 9/1883 | Tatum | ..... | B65D 5/106 229/158 |

(Continued)

*Primary Examiner* — Robert F Long
*Assistant Examiner* — Eduardo R Ferrero
(74) *Attorney, Agent, or Firm* — Westerman, Hattori, Daniels & Adrian, LLP

(57) ABSTRACT

An expansion devise includes an unexpanded slit sheet roll that is wound on a paper core that is wider than the slit sheet paper. The paper core is placed into a yoke that holds the paper in position on each side of the unexpanded slit sheet material. An adjustable downward pressure is exerted on the paper core and the paper core exerts pressure on the yoke. As the paper is pulled, this downward pressure creates the friction required to enable the unexpanded slit sheet to be unwind and fed while simultaneously expanding. A blank sheet is formed into a box that stabilizes slit paper sheet wound around a core member.

7 Claims, 10 Drawing Sheets

(56) References Cited

U.S. PATENT DOCUMENTS 301,791 A * 7/1884 Bisler ..... B65D 5/106 229/158
528,639 A * 11/1894 Lindemeyer, Jr. ..... B65D 5/106 229/158
1,602,702 A * 10/1926 Pinkerton ..... B65D 5/106 229/114
2,030,295 A * 2/1936 Hodge ..... B65D 5/106 229/125
2,060,240 A * 11/1936 Pergande ..... B65D 5/106 229/155
2,265,280 A * 12/1941 Groves ..... B65D 5/106 229/125.39
2,293,187 A * 8/1942 Becker ..... B65D 5/3621 206/389
2,325,277 A * 7/1943 Rothe ..... A47F 1/085 221/63
2,337,198 A * 12/1943 Holy ..... B65D 5/106 229/157
2,349,707 A * 5/1944 Esposito ..... B65D 5/106 229/155
2,443,428 A * 6/1948 Lambert ..... B65D 5/106 229/155
2,481,288 A * 9/1949 Cage ..... B65D 5/106 229/142
2,666,567 A * 1/1954 Farrell ..... B65D 5/106 229/155
2,743,009 A * 4/1956 Williamson ..... B65D 85/672 206/396
2,748,931 A * 6/1956 Taylor ..... B65D 85/672 225/34
2,848,104 A * 8/1958 Schor ..... B65D 85/672 206/391
3,003,679 A * 10/1961 Andrews ..... B65D 5/106 229/158
3,228,519 A * 1/1966 Dong ..... B65D 85/672 242/564
3,338,399 A * 8/1967 Burt ..... B65D 5/5026 206/395
3,447,735 A * 6/1969 Whitney ..... B65D 5/541 229/244
3,477,624 A * 11/1969 Harshbarger ..... B65D 83/0841 225/43
3,520,409 A * 7/1970 Gibbs, Sr. ..... B65D 5/5021 242/588.4
3,613,973 A * 10/1971 Jaeschke ..... B65D 85/672 225/47
3,679,110 A * 7/1972 Stine ..... B65D 85/672 225/47
3,698,548 A * 10/1972 Stenzel ..... B65D 83/0882 242/588.4
3,718,251 A * 2/1973 Barnett ..... B65D 83/0847 206/408
3,790,064 A * 2/1974 Kramer ..... B65D 5/106 229/117
3,942,417 A * 3/1976 Finn ..... B65D 83/0882 493/86
3,974,914 A * 8/1976 Cross ..... B65D 85/672 206/408
4,017,017 A * 4/1977 Vos ..... B65D 5/008 229/101
4,151,914 A * 5/1979 Blatt ..... B65D 85/66 206/386
4,201,331 A * 5/1980 Austin ..... B65D 5/064 229/140
4,238,065 A * 12/1980 Ragsdale ..... B65D 85/672 206/409
4,298,123 A * 11/1981 Roccaforte ..... B65D 85/672 206/396
4,651,911 A * 3/1987 Kirkup ..... B65D 83/0841 225/20
4,714,191 A * 12/1987 Richardson ..... B65D 33/002 206/390
4,715,519 A * 12/1987 Fischer ..... B65D 85/672 225/48
4,813,539 A * 3/1989 Church ..... B65D 85/672 206/396
4,998,656 A * 3/1991 Hurh ..... B65D 85/672 225/47
5,131,903 A * 7/1992 Levine ..... B31D 5/0043 206/395
5,141,108 A * 8/1992 Roccaforte ..... B65D 85/672 206/396
5,301,854 A * 4/1994 Scobey ..... B26F 3/02 225/34
5,449,070 A * 9/1995 Broderick ..... B65D 85/671 206/396
5,538,778 A * 7/1996 Hurwitz ..... B31C 5/00 206/521
5,667,871 A * 9/1997 Goodrich ..... B31C 5/00 206/521
5,688,578 A * 11/1997 Goodrich ..... B21D 31/04 206/521
5,704,479 A * 1/1998 Barnett ..... B65D 85/04 206/395
5,782,735 A * 7/1998 Goodrich ..... B31D 1/0031 225/100
5,971,150 A * 10/1999 Anderson ..... B65D 85/672 206/389
6,117,062 A * 9/2000 Alhamad ..... B21D 31/04 493/363
6,412,725 B2 * 7/2002 Inana ..... B65H 16/06 242/348
6,899,226 B2 * 5/2005 Voissem ..... B65D 85/66 206/389
6,926,192 B1 * 8/2005 Dowd ..... B65D 5/3621 229/117
6,935,501 B2 * 8/2005 Gerulski ..... B65D 83/0805 206/396
7,284,725 B2 * 10/2007 Inana ..... B41J 15/042 242/578
8,025,209 B2 * 9/2011 Garner ..... B65D 5/18 229/120.09
9,340,348 B2 * 5/2016 Masague ..... B65D 5/10
2001/0034998 A1 * 11/2001 Yamaai ..... B65D 19/0012 53/409
2003/0009988 A1 * 1/2003 Deis ..... B65D 81/03 53/449
2011/0036904 A1 * 2/2011 Lopez Masague .... B65D 5/003 229/126
2011/0048993 A1 * 3/2011 Gretzinger ..... B65D 5/0227 206/391
2012/0187018 A1 * 7/2012 Maglio ..... B65D 5/0254 206/524.4
2014/0027553 A1 * 1/2014 Page ..... B65H 16/005 242/159
2014/0138262 A1 * 5/2014 Rajter, Jr. ..... B65D 5/103 206/1.5
2017/0121140 A1 * 5/2017 Walder ..... B65D 5/4266

* cited by examiner

SLIT PAPER EXPANSION METHOD AND APPARATUS

This application claims priority to provisional application 62/425,200 filed Nov. 22, 2016 and is a continuation-in-part of non-provisional patent application Ser. No. 15/428,144 filed Feb. 8, 2017, the disclosures of which are incorporated by reference in their entirety, referenced and recited herein as if in full as part of the description of the present invention.

BACKGROUND OF THE INVENTION

Field of the Invention

This invention provides a simple method of expansion and shipment for expanded slit paper materials for wrapping and void fill for packaging items within a box for shipment. A second inventive step is an improved unpowered expander method for expansion and paper loading.

Description of the Prior Art

The expanded slit paper prior art is disclosed in U.S. Pat Nos. 5,538,778, 5,667,871, 5,688,578, and 5,782,735, are incorporated by reference in their entirety, referenced and recited herein as if in full as part of the description of the present invention. The prior art consists of layering a wrapping comprising a combination of a tissue interleave sheet and an expanded slit sheet for the purposes of cushioning fragile items for shipment. The prior art also relates to a method of expanding the slit sheet material using ran electrically powered apparatus.

SUMMARY OF THE INVENTION

A main object of the present invention is to overcome the shortcomings of the prior art.

In accordance with a broad embodiment of invention, the use of predominantly virgin paper for the manufacture of expanded slit paper provides a chaotic opening that eliminates the requirement for tissue paper between the expanded slit sheet layers. In accordance with a broad embodiment of the invention, the use of a fold line within the flaps of a packing box is used for shipping the expanded slit paper to block and brace the paper core at each end while blocking and bracing the unexpanded slit sheet paper wound around the paper core that is narrower in width than the paper core. In accordance with a broad embodiment of the invention, an expansion devise for slit sheet expanded materials utilizes pressure mechanism that is removable for easy paper loading for one and two layer systems.

In accordance with a broad embodiment of the invention, an improved unpowered manual expansion device provides a smoother expansion process and easier loading method than prior art systems.

BRIEF DESCRIPTION OF DRAWINGS

The invention will be described with the accompanying drawings in which.

DESCRIPTION OF THE EMBODIMENTS OF THE INVENTION

Definitions

Where the definition of terms departs from the commonly used meaning of the term, applicant intends to utilize the definitions provided below, unless specifically indicated otherwise.

For the purposes of the present invention, the term "rotatable panel" as employed herein, means the part of a corrugated box that rotates at a fold line creating a hinge that provides the top and bottom sides of a corrugated box that folds perpendicular to the sides of the corrugated box on which it is attached.

For the purposes of the present invention, the term "rotatable sub-panel" as employed herein, means the part of the container formed from a blank, that is contiguous with the rotatable panel that further folds across a fold line creating a hinge that folds perpendicular to the plane of the rotatable panel.

For the purposes of the present invention, the term "sine wave" as employed herein, means a continuous wave across a thin material that forms hills and valleys.

For the purposes of the present invention, the term, "telescope" as employed herein, means a lateral movement of roll of paper along the axis of the core member, including minimal lateral movement at the region of the roll having the smallest diameter and larger lateral movement at the region of the roll having the largest diameter.

For the purposes of the present invention, the term, "parcel post" as employed herein, means any method of transportation of products that enables smaller type boxes to be shipped for a fee without the need for a pallet.

For the purposes of the present invention, the term, "cross members" as employed herein, means the framework that separates and holds in position the yokes.

For the purposes of the present invention, the term, "yoke" as employed herein, means the portions of the expander that support the roll of slit sheet expandable paper at each end of the paper core.

For the purposes of the present invention, the term, "paper core" as employed herein, means the round paper tube that the expanded slit sheet paper is wound.

For the purposes of the present invention, the term, "roll holder" means a fixture that applies a force against a core member to modulate the friction applied to the core member and thereby control the resistance to the unrolling of a slit paper wound upon the core member, as required to cause the slit paper to expand during the unwinding process.

For the purposes of the present invention, the term "virgin Kraft paper" means paper virgin wood fiber paper manufactured without the use of any recycled paper fibers.

Figure 9:
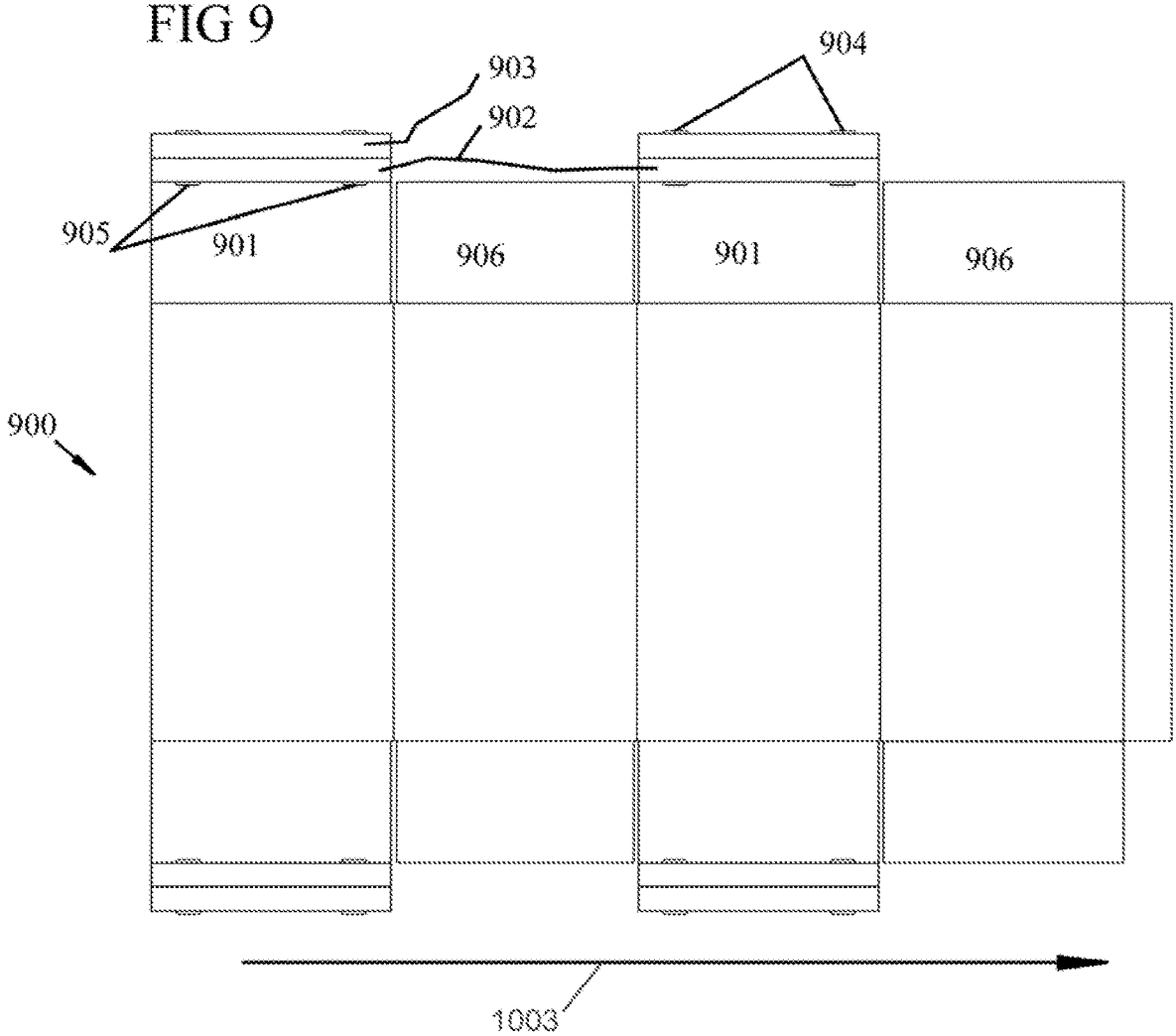
FIG. 9 is a line drawing of an alternative blank for forming a corrugated box.

For the purposes of the present invention, the term "contiguous" means sharing a common border, including a fold line. Two regions or panels that are not connected to each other are not contiguous. All of the side wall forming panels 110 are separated from each other only by fold lines and thus are contiguous. Similarly, panels 110 are separated from panels 205 only by fold lines and thus are contiguous. In contrast to the term "contiguous", for the purposes of the present invention, the term "adjacent" means in close proximity to, but not touching. As illustrated in FIG. 9, panels 901 are adjacent to panels 906 but are separated from each other.

DETAILED DESCRIPTION OF THE INVENTION

Random, Irregularly Opening Expanded Slit Sheet Material.

The new art provides a simpler solution for manufacturing slit sheet expanded material when a single expanded sheet is preferable to use versus the dual cross layered expanded sheets in pending U.S. patent application Ser. No. 14/480,319. The disclosures of U.S. patent application Ser. No. 14/480,319, filed Sep. 8, 2014, Ser. No. 15/001,168 filed Jan. 19, 2016; Ser. No. 62/571,382, filed Oct. 12, 2017 are incorporated herein by reference in its entirety, and recited herein as if in full as part of the description of the present invention.

Prior to the use of on or around 80% virgin fibers or more, the wedge effect or lack thereof was instrumental in the manufacture of uniformly opened or randomly opened cells. The new art, using Kraft paper having in the range of 80 percent or more virgin fibers, is employed in the production of the slit sheet expandable paper, without the use of modified paper slitting tooling. Thus, the wedge would has little or no effect on the paper. Presently, and explained in Applicant's prior patent applications, such as Ser. Nos. 14/480,319 and 15/001,168, a wedge effect places an emphasis in cell opening direction by which one skilled within the art can orient the tooling to continuously open the cells either forward or backward dependent upon the wedge orientation of forward or rearward of the direction of the manufacturing process. Now, the same tooling, oriented to produce uniformly opening cells in recycled paper can be used for producing randomly, irregularly opening cells with virgin paper without having to alter the tooling. This saves time, labor, and tooling costs that normally would have required separate tooling for each type required.

The term "random" as employed herein with regard to the opening of cells, means that at least twenty (60%) percent and preferably at least eighty (80%) percent of the cell undergo switch backs. Preferably, no more than fifteen (15) adjacent cells have uniform angles of inclination. That is 15 cells going in the cross direction of manufacture and fifteen (15) cells going with the direction of manufacture would make up one block of cells all facing the same direction. Preferable only five (5) cells in either direction are preferable with optimal cell clusters being three by three (3×3). Cells running diagonal can be included in this calculation.

For the purposes of the present invention, the term "switch back" means the reversal of the angle of the inclination of the land at some point or points along the length of the sheet of expanded slit sheet material. A reversal of the angle of inclination constitutes a switch back. By way of example, a reversal of the angle of inclination from an inclination of about +60 to about −60 degrees (60 to 120 degrees) constitutes a switch back. Switch back can occur due to extraneous forces other than the wedge effect which causes rows of cells that to reverse themselves, as disclosed in U.S. Ser. No. 14/480,319. In this instance, the creation of chaotic cells is a function of the randomly accumulated long curly fibers that make up a paper sheet such creating switch backs, not in rows or in clumps, but at a cell to cell level.

For the purposes of the present invention, the term "nesting" means the grouping of cells into or onto one another such that an upper slit sheet material cell can fit within the lower slit sheet material cell to the point at which the thickness gain is not substantial. Preferably, the nesting produces a loss of thickness of two adjacent layers of no great than about 15%, and most preferably, the nesting produces a loss of thickness of two adjacent layers of no great than about 10% but, preferably no greater than 20%.

Virgin fibers are long and not straight. During the paper manufacturing process the fibers curl and twist into a variety of fashions as they fall on the screen that enable the fibers to fall onto to being the paper making process. The screen allows the water, used for the vehicle to drive the fibers to the screen. The screen is moving in the direction of the manufacturing process and thus creates a continuous sheet of paper past the filtering process to the drying and flattening process. The fibers dry in a tangled web of multiple and interweaving layers. As the fibers dry the memory of their original shape returns. This memory is static such that, if it is a continuous sheet, the layers of randomly layered fibers keep the sheet flat.

When recycled, paper is cut there is dust created. This dust is as a result of pulverizing the fibers. These fibers are very short are easily removed by/during the die cutting process. Conversely, the long fibers of the virgin paper, being long and resilient, are cut and not pulverized. This creates a lengthening of the paper that can only be accounted for by an accumulation creating a sine wave. This fiber memory creates an undulating or sine wave effect on the paper of about 0.03-0.06" from the top of the sine to the bottom running transversely to the direction of manufacture or in the direction of the slits within the paper and a smaller sine wave exists every one-quarter inch in the direction of manufacture. The top of the sine wave is every other slit row in a repeating pattern.

These rows of sine wave easily overcome the subtle impression that the wedge effect applies to the paper and subsequently the expansion process is far from uniform as each sine wave turns the paper forward or backward in an even greater chaotic pattern then when using a center bevel tool without that provides no wedge effect.

Prior teachings of making expanded slit paper express a need for the sheet to be flat sheet in order to produce tightly wound rolls. The paper in this instance does not wind up as tightly but, the increased random opening of the cells more than overcomes this shortfall by providing a non-nesting layering that creates a larger diameter roll than the two-layer interlocking system of the prior art.

Box for Unexpanded Slit Sheet Material on a Roll.

Packaging the roll of expanded slit sheet material is unlike any system required to ship a wound roll of material. The preferred shipment method is to place the roll in a box exactly sized to optimally fill the space within the box for shipping. The new art requires additional protection for the paper core that extends, in this instance approximately one and half inches from each side of the paper roll. The paper core can be easily damaged as well as the wound unexpanded slit sheet material can telescope easily if the box were to ship in its vertical position or dropped.

The new art solves this problem without any added cost to the packaging by adding a score line to the box flaps, a rotatable panel so that an additional rotatable sub-panel is created that can be folded inward to press against the wound paper as it rubs against the exterior of the paper core. This design is easily done without tooling by the manufacture of corrugated boxes and without additional cost.

Manual Expander Design

The new manual expander art provides the same service as the prior art of non-provisional patent Ser. No. 15/428,144. The disclosures of U.S. patent application Ser. No. 15/428,144 is incorporated herein by reference in its entirety, as if it were recited in full as part of the description of the present invention. The new art provides several improvements to simply use, shipment, and assembly.

Figure 7:
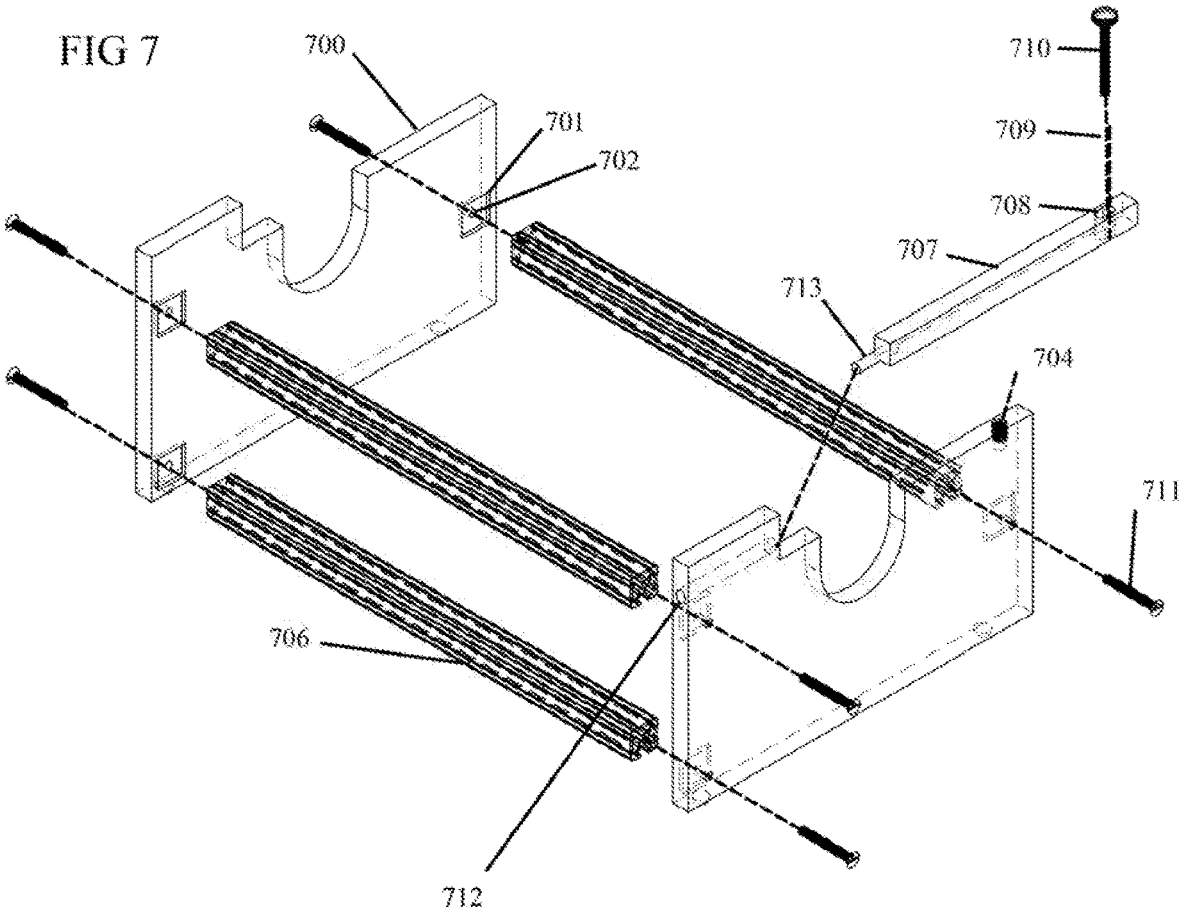
FIG. 7 is a perspective view of the single layer expansion system unassembled exploded view.

The first improvement enables the expander to be shipped unassembled saving significant Parcel Post freight costs. This is done by using six screws and extruded aluminum cross members connected to the yokes with a screwdriver as can be seen in FIG. 7. The prior box for the single expander was 21×10×8 inches and has been reduced to 16×10×4 inches with a reduction in shipping weight from 8 to 6 pounds. The Double expander previously shipped in a box 24×12×28 inches has been reduced to 22×14×4 inches with a reduction of weight from 28 to 24 pounds.

The second improvement is with the use of a thinner wood material for the yokes. These are held apart by the cross members. The thinner wood reduces the friction against the paper core and provides an easier expansion with less ripping.

The third improvement is the use of a removable roll holder. This enables the double layer expander to be constructed with one double yoke on each side and not one lower and upper yoke that required separation prior to loading the bottom slit sheet roll. This reduces the labor and the lifting of 20 pounds to just separate the yokes. By removing the roll holder, the roll can be slid into place quickly. The roll holder is connected to the yoke at the back end with a dowel that fits into a guiding hole and is attached by a thumb screw to the yoke.

Figure 1:
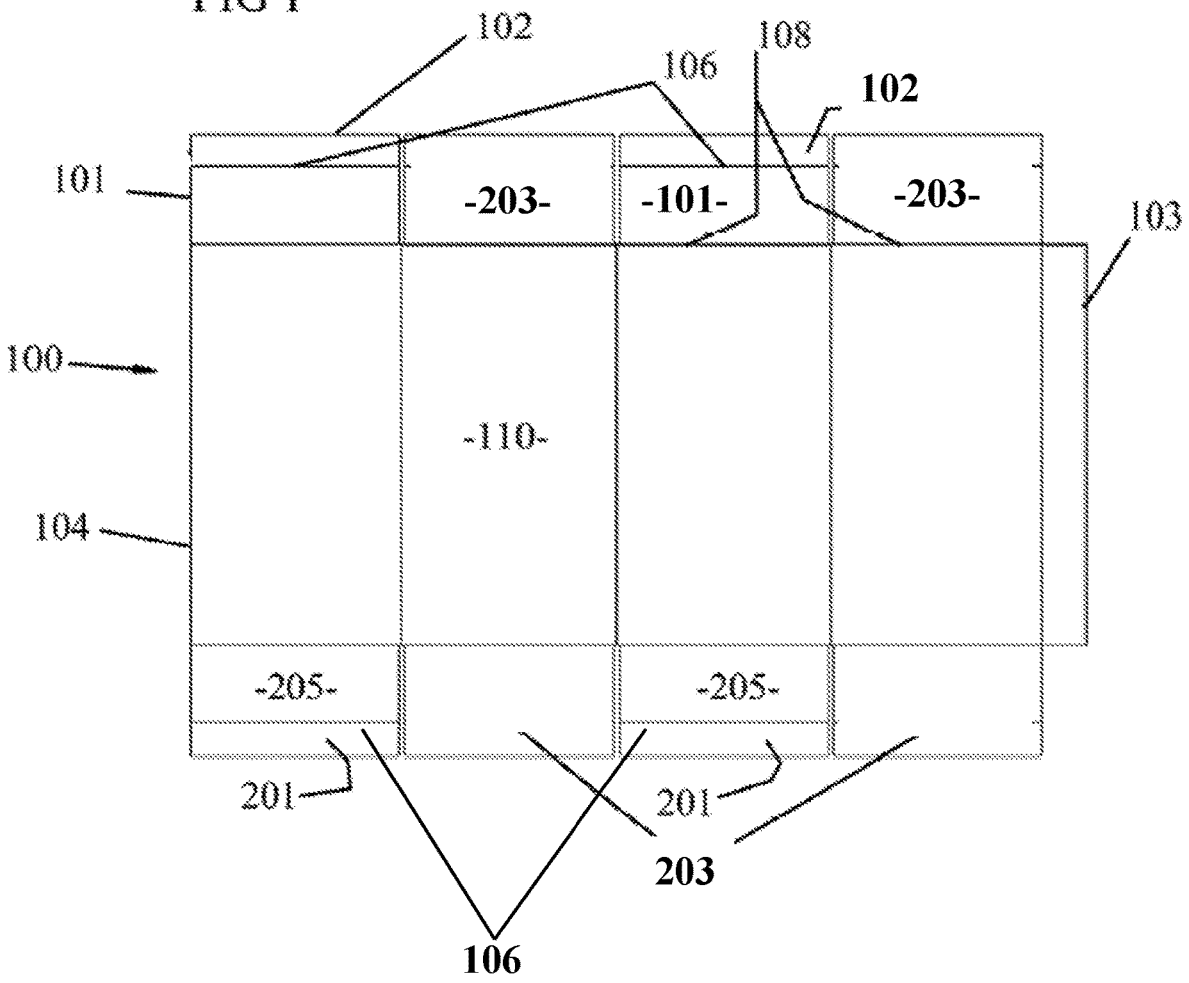
FIG. 1 is a line drawing of the blank for forming a corrugated box.

Now Looking at the Drawings:

FIG. 1 is a flat unassembled view of the blank for forming a corrugated box where 100 represents the blank that contains four rectangular main panels 110 that make up the body of the box. Tab panel 103 is a glue tab that is used for securing the two opposing end panels 110 during the assembly of the blank into a box. Sub-panels 101 (203) and 102 (201) and 203 make up the entire rotatable panels that are on each end of the body of the box where 102 (201) becomes the sub-panel that will fold downward against the paper roll 206 and core 204, when the blank 100 is assembled into the form of a box 200, and the paper roll is inserted into the box 200. The panels 110 as seen in FIG. 1 are contiguous with each other and each panel 110 is contiguous with a sub-panel 101. Each sub-panel 101 (205) is contiguous with an end sub-panel 102 (201), but the sub-panels 101 are proximate to but not contiguous with each a sub-panel 203. Fold lines 106 form a boundary between sub-panels 101 (205) and 102 (201), and fold lines 108 form a boundary between sub-panels 101 (205) and 203 and main panels 110. Similarly, there is a fold line between each contiguous main panel 110 and between a main panel 110 and the tab panel 103.

Figure 2:
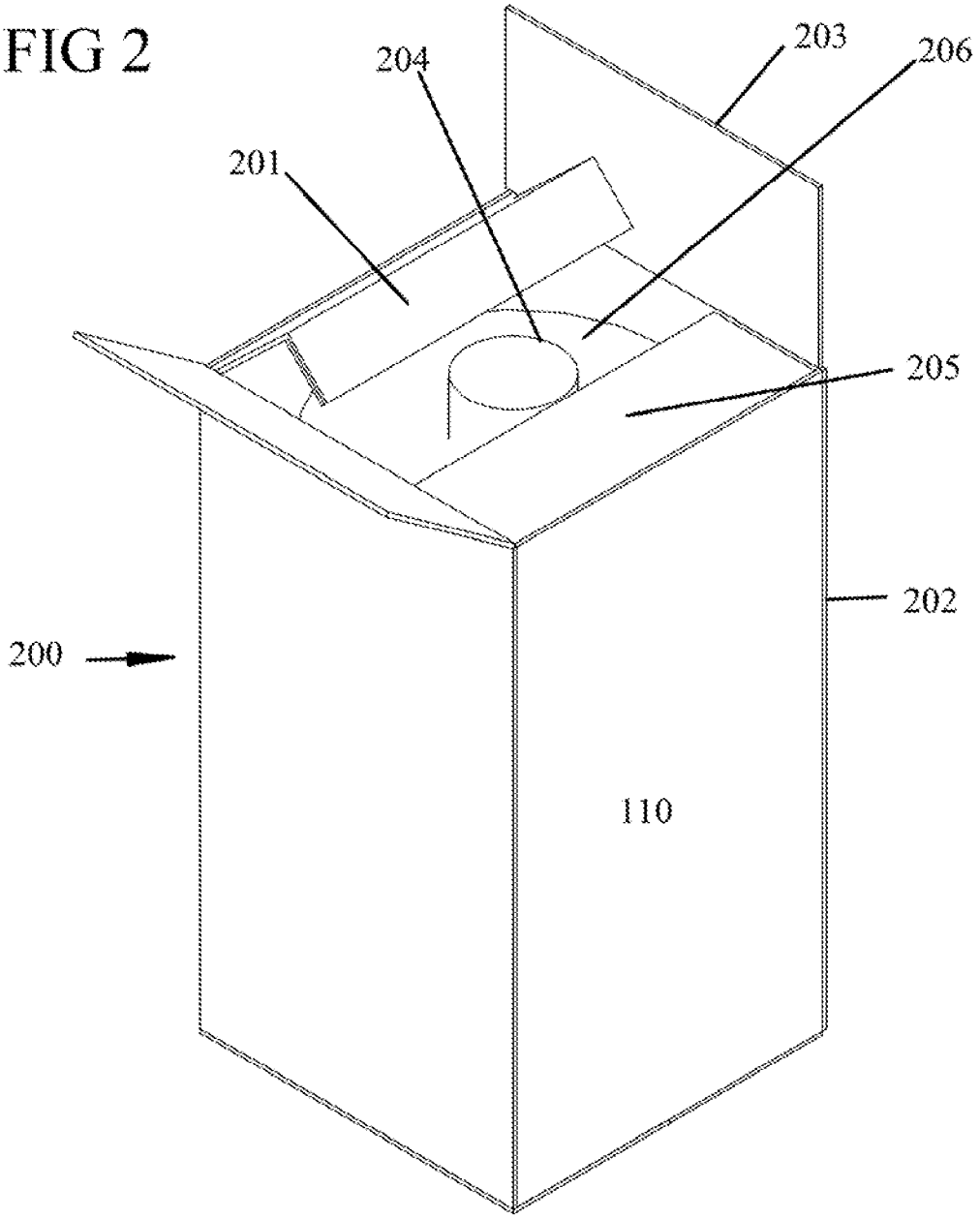
FIG. 2 is a perspective view of the corrugated box supporting the roll and paper core.

FIG. 2 is a perspective view of the box 200 where the paper roll 206 is wrapped around the paper core 204 and is in position to receive flap 201 as shown. Main panel 110 has its fold line 202 in a perpendicular position as shown FIG. 2. Rotatable sub-panel 205 has a contiguous rotatable sub-panel on the right side of paper core 204 that cannot be seen but, will be positioned parallel to rotatable sub-panel 201 when rotatable sub-panel 201 is in its position for shipping.

Figure 3:
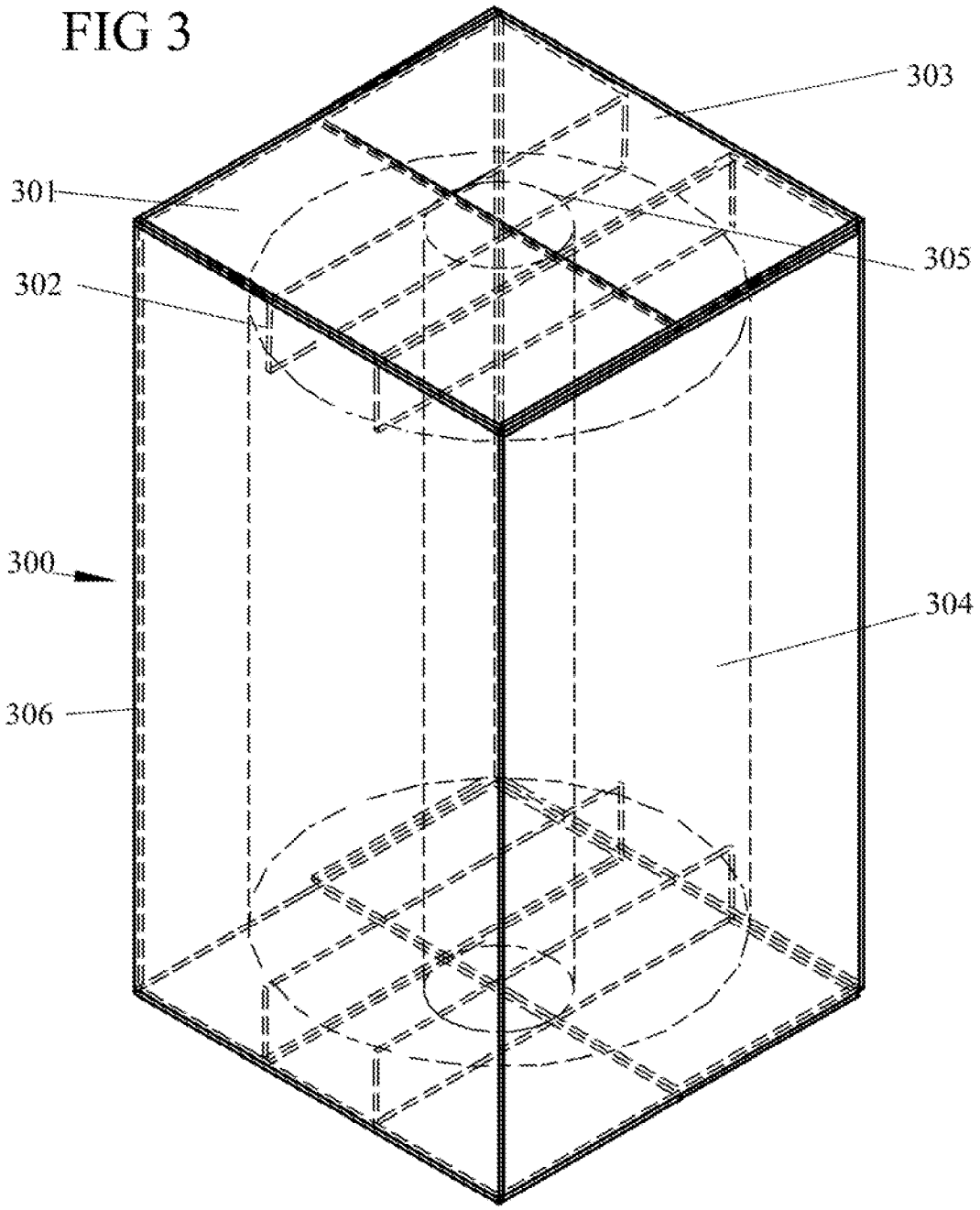
FIG. 3 is a perspective view of the corrugated box in its closed and ready to ship position.

FIG. 3 is a perspective view the box 300 that is ready to ship with rotatable panels 301 and 303 perpendicular to the box sides 306 and rotatable sub-panels 302 are parallel to the box sides 306 and pressing against paper roll 304 and paper core 305.

Figure 4:
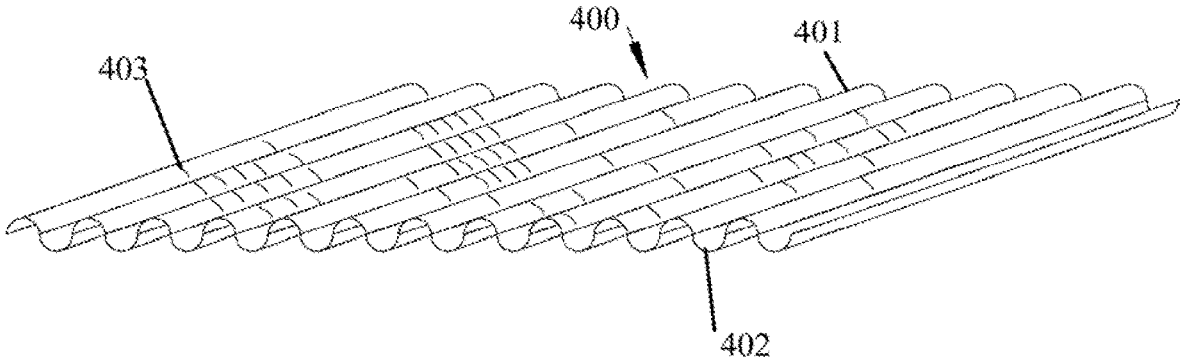
FIG. 4 is a perspective view of the virgin unexpended slit material.

FIG. 4 is a perspective view of the virgin unexpanded slit sheet material 400 made of paper where, 403 is the rows of slits followed by the un-slit portion 404. The regions making up the upper 401 and lower 402 undulations of the sine wave formed when using virgin paper runs perpendicular to the slit direction 403.

Figure 5:
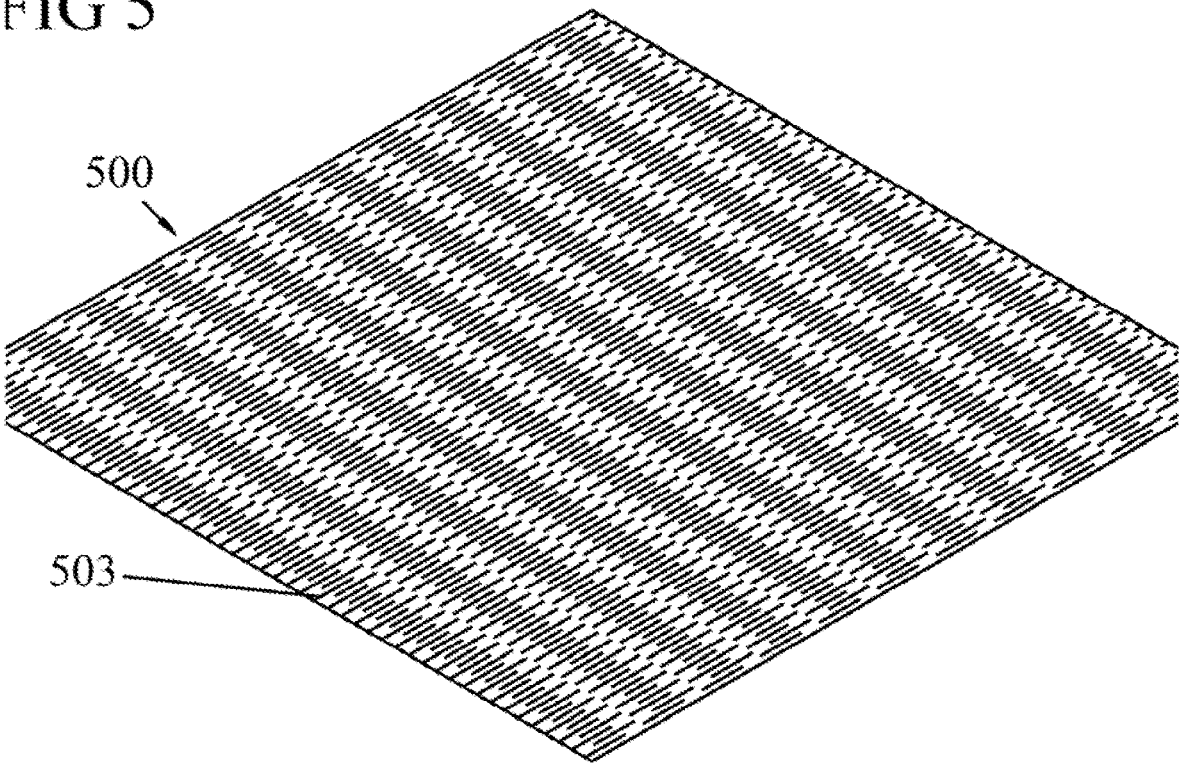
PRIOR ART FIG 5
FIG. 5 is a perspective view of a recycled unexpended slit material.

FIG. 5 is a perspective view of the recycled unexpanded slit sheet material 500 made of paper where, 503 is the rows of slits followed by the un-slit portion 504. The paper after manufacturing is virtually flat.

Figure 6:
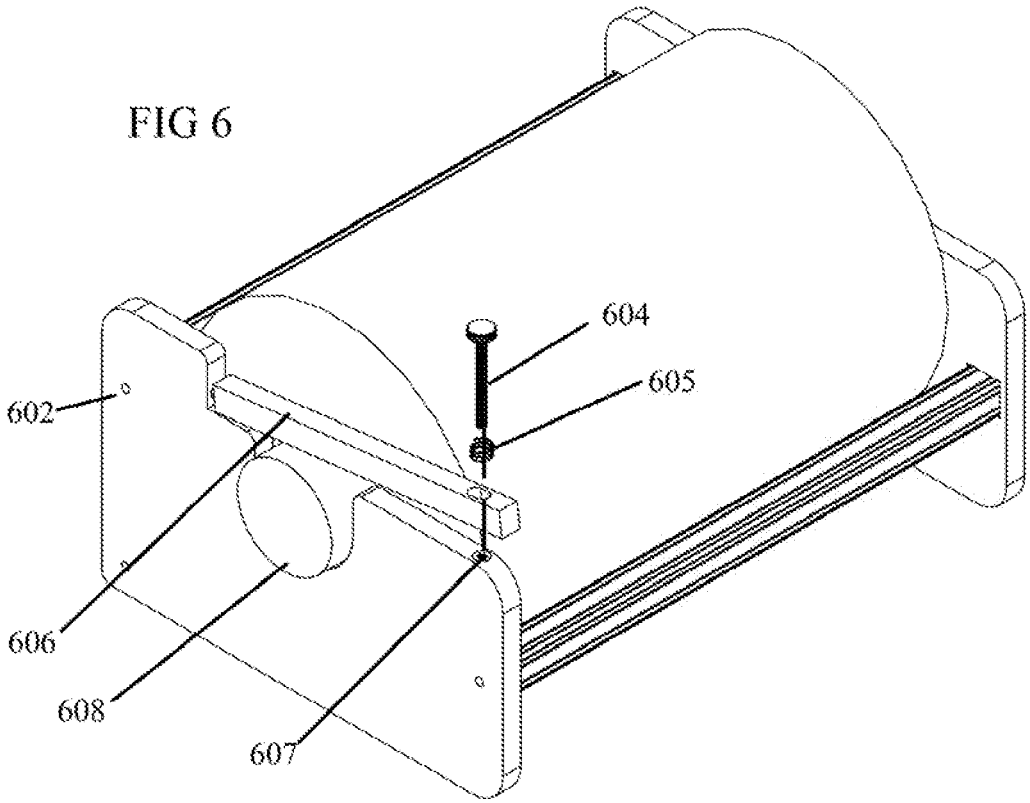
FIG. 6 is a perspective view of the single layer expansion system.

FIG. 6 is the single expansion apparatus 600 that is made up of two yokes 602 and three cross members 601. Paper core 608 sits in the yoke 602 and holds the paper roll 603 that is wound around it. A threaded insert 607 receives thumb screw 604, firstly through the spring 605 and then through roll holder 606 and into the metal threaded insert 607 to enable the roll holder to apply downward pressure to the paper core 608.

FIG. 7 is a perspective view of the unassembled manual expander where yokes 700 accept cross members 706 into recessed areas 701 on the 700 and are secured using screws 711 through the yoke hole 703 into cross member 706. Roll holder 707 accesses yoke hole 712 to secure its position on the rear of the yoke while thumb screw 710 passes through spring 709 and through roll holder 707 through hole 708 into metal threaded fixture 704.

Figure 8:
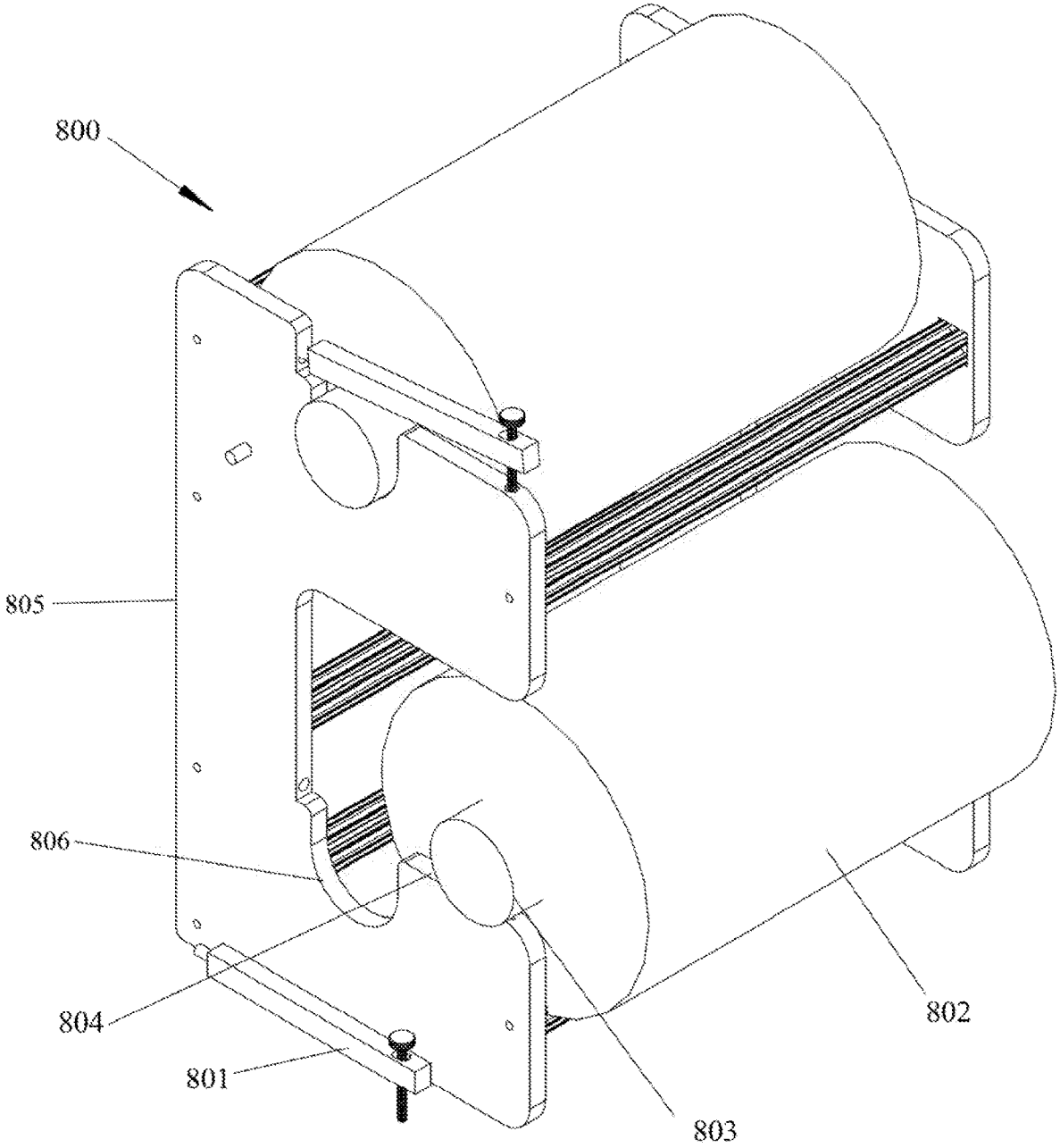
FIG. 8 is a perspective view of the double layer expansion system.

FIG. 8 is a perspective paper loading view of double manual expander 800 that shows lower roll holder assembly and thumb screw 801 removed and resting next to the double manual expander 800. Paper roll 802 connected to paper core 803 is being guided towards yoke opening 806 on which paper core 803 will rest.

Figure 10:
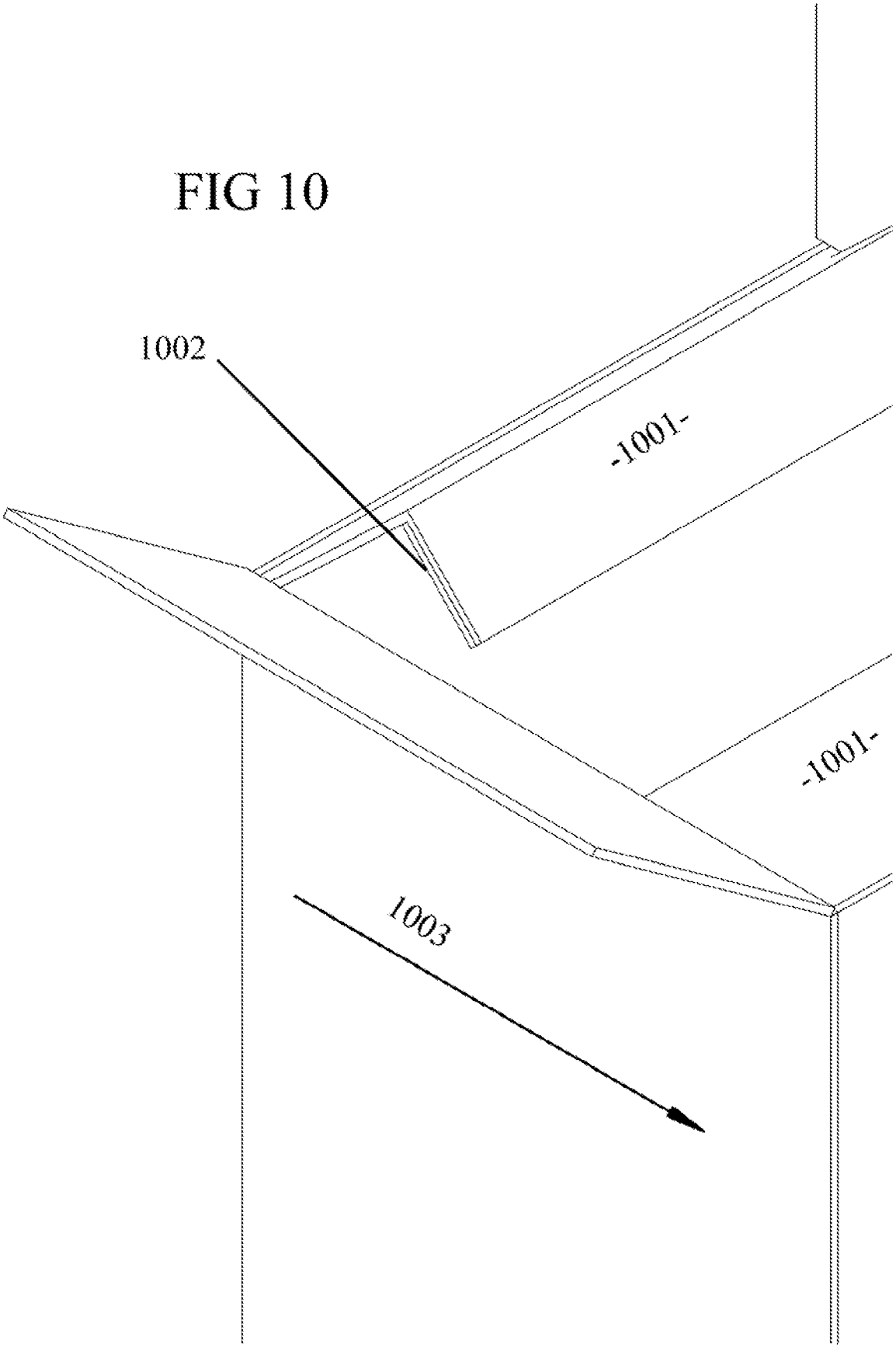
FIG. 10 is a perspective view of a corrugated box formed from the blank of FIG. 9.

FIG. 9 is a line drawing of an alternative blank 900 for forming the corrugated shipping container of FIG. 10. The alternate design for the corrugated box changes the direction of corrugation as indicated by arrow 1003, so that the strength of the box is in the width as shown by arrow 1003. The box construction is identical to that of FIG. 1, except for panels 901 are now connected to panels 902 and locked in position after it is folded over as shown in FIG. 10 using locking tabs 904 fitting into lock tab openings 905. This design provides the stacking strength required to maximize the stacking of containers as they sit on a pallet and/or are stacked to the full height of a trailer truck. The alternative design of the shipping box of FIG. 9, in its manufactured blank form 900, is almost identical to the box design of FIG. 1 except for the additional told-over flaps 903 that are connected to the flap 902 (which corresponds to flaps 205 of FIG. 1) that is connected to flap 901. Additionally, which, has two slot openings 905 are provided to capture the locking tabs 904 that are attached to the additional length flap 903 so that when 903 is folded over it is firmly locked in place. Adjacent flaps 906 correlate to flaps 203 of FIGS. 1 and 2.

FIG. 10 shows panels 1001 and 1002 folded over to form a double layer of corrugated board. Arrow 1003 represents the direction of the corrugations. Thus, the corrugations are at right angles to the fold lines between the main panels that form the side walls of the container. The alternate of FIG. 9 in its setup configuration for the corrugated box changes employs a direction of the corrugations so that the strength of the box is in the width as shown by arrow 1003. The box construction is substantially identical to the container of FIGS. 2 and 3, except that panel 1001 is now contiguous with panel 1002 and separated from panel 1002 by a fold line. Panel 1002 and locked in position after it is folded over as shown in FIG. 9 using locking tabs 904 fitting into lock tab openings 905. This design provides the stacking strength required to maximize the ability of the containers to be stacked as they sit on a pallet and are stacked to the full height of the trailer.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of this disclosure (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., such as, preferred, preferably) provided herein, is intended merely to further illustrate the content of the disclosure and does not pose a limitation on the scope of the claims. No language in the specification should be construed as indicating any non-claimed element as essential to the practice of the present disclosure.

Multiple embodiments are described herein, including the best mode known to the inventors for practicing the claimed invention. Of these, variations of the disclosed embodiments will become apparent to those of ordinary skill in the art upon reading the foregoing disclosure. The inventors expect skilled artisans to employ such variations as appropriate (e.g., altering or combining features or embodiments), and the inventors intend for the invention to be practiced otherwise than as specifically described herein.

Accordingly, this invention includes all modifications and equivalents of the subject matter recited in the claims appended hereto as permitted by applicable law. Moreover, any combination of the above described elements in all possible variations thereof is encompassed by the invention unless otherwise indicated herein or otherwise clearly contradicted by context.

The use of individual numerical values are stated as approximations as though the values were preceded by the word "about", "substantially", or "approximately." Similarly, the numerical values in the various ranges specified in this application, unless expressly indicated otherwise, are stated as approximations as though the minimum and maximum values within the stated ranges were both preceded by the word "about", "substantially", or "approximately." In this manner, variations above and below the stated ranges can be used to achieve substantially the same results as values within the ranges. As used herein, the terms "about", "substantially", and "approximately" when referring to a numerical value shall have their plain and ordinary meanings to a person of ordinary skill in the art to which the disclosed subject matter is most closely related or the art relevant to the range or element at issue. The amount of broadening from the strict numerical boundary depends upon many factors. For example, some of the factors which may be considered include the criticality of the element and/or the effect a given amount of variation will have on the performance of the claimed subject matter, as well as other considerations known to those of skill in the art. As used herein, the use of differing amounts of significant digits for different numerical values is not meant to limit how the use of the words "about", "substantially", or "approximately" will serve to broaden a particular numerical value or range. Thus, as a general matter, "about", "substantially", or "approximately" broaden the numerical value. Also, the disclosure of ranges is intended as a continuous range including every value between the minimum and maximum values plus the broadening of the range afforded by the use of the term "about", "substantially", or "approximately". Thus, recitation of ranges of values herein are merely intended to serve as a shorthand method of referring individually to each separate value falling within the range, unless otherwise indicated herein, and each separate value is incorporated into the specification as if it were individually recited herein. To the extent that determining a given amount of variation of some the factors such as the criticality of the slit patterns, paper width differential pre- and post-expansion, paper weights and type, as well as other considerations known to those of skill in the art to which the disclosed subject matter is most closely related or the art relevant to the range or element at issue will have on the performance of the claimed subject matter, is not considered to be within the ability of one of ordinary skill in the art, or is not explicitly stated in the claims, then the terms "about", "substantially", and "approximately" should be understood to mean the numerical value, plus or minus 15%.

It is to be understood that any ranges, ratios and ranges of ratios that can be formed by, or derived from, any of the data disclosed herein represent further embodiments of the present disclosure and are included as part of the disclosure as though they were explicitly set forth. This includes ranges that can be formed that do or do not include a finite upper and/or lower boundary. Accordingly, a person of ordinary skill in the art most closely related to a particular range, ratio or range of ratios will appreciate that such values are unambiguously derivable from the data presented herein.

What is claimed is:

1. A corrugated shipping container formed from a blank sheet of corrugated board, said blank sheet having:

a) four rectangular main panels, each contiguous with at least one other of said four rectangular main panels;

b) a first set of four foldable panels, each panel of said first set of foldable panels being contiguous with a first edge of a respective rectangular main panel of said four rectangular main panels, and separated therefrom by a fold line;

c) a second set of four foldable panels, each panel of said second set of foldable panels being contiguous with a second edge of a respective rectangular main panel of said four rectangular panels, and separated therefrom by a fold line;

d) each foldable panel of said first set of four foldable panels being proximate to but not contiguous with at least one proximate panel of said first set of four foldable panels;

e) each foldable panel of said second set of four foldable panels being proximate to but not contiguous with at least one proximate panel of said second set of four foldable panels;

f) each of two of said first set of four foldable panels being subdivided by a fold line and forming a first and a second foldable end panel, wherein the first foldable end panel is foldable to a position substantially perpendicular to a plane of the respective contiguous rectangular main panel and the second foldable end panel is foldable to a position substantially parallel to the plane of the respective contiguous rectangular main panel, such that the second foldable end panel extends inwardly into said corrugated shipping container in order to support a first end of a paper roll and a first end of a paper core within the corrugated shipping container, said second foldable end panel supporting the first end of the paper core by a substantially planar outer surface of the second foldable end panel that extends alongside the periphery of the first end of the paper core a distance greater than a thickness of the second foldable end panel;

g) each of two of said second set of four foldable panels being subdivided by a fold line and forming a third and a fourth foldable end panel, wherein the third foldable end panel is foldable to a position substantially perpendicular to a plane of the respective contiguous rectangular main panel and the fourth foldable end panel is foldable to a position substantially parallel to the plane of the respective contiguous rectangular main panel, such that the fourth foldable end panel extends inwardly into said corrugated shipping container in order to support a second end of the paper roll and a second end of the paper core within the corrugated shipping container, said fourth foldable end panel supporting the second end of the paper core by a substantially planar outer surface of the fourth foldable end panel that extends alongside the periphery of the second end of the paper core a distance greater than a thickness of the fourth foldable end panel.

2. The corrugated shipping container of claim 1, further comprising:

each of said four contiguous rectangular main panels being rotated about a fold line to a position at a right angle to a contiguous rectangular main panel, and a tab panel contiguous with a first end panel of said four rectangular main panels, being rotated to a position wherein it is in an overlapping contact with a second end panel of said four rectangular main panels and secured thereto.

3. The corrugated shipping container of claim 2, further comprising:

a) a roll of expandable slit sheet paper wound on an interior core member, b) said core member having an axial length that is greater than the width of the slit sheet paper that is wound on said core member;

c) said roll of expandable slit sheet paper being positioned within said four contiguous rectangular main panels, each of said rectangular main panels being rotated about a fold line to a position at a right angle to a contiguous rectangular main panel, and having a first end panel of said four rectangular main panels rotated to a position in contact with a second end panel and secured thereto, d) said second foldable end panel being rotated about a fold line to a position substantially parallel to both a rectangular main panel and the axis of said core member and positioned to contact with said core member and having an edge positioned to contact with said roll of expandable slit paper;

e) said fourth foldable end panel being rotated about a fold line to a position substantially parallel to both a rectangular main panel and the axis of said core member and positioned to contact with said core member and having an edge positioned to contact with said roll of expandable slit paper.

4. The corrugated shipping container of claim 3, further comprising:

said first end panel of said four rectangular main panels being secured to said second end panel by an overlapping tab panel.

5. The corrugated shipping container of claim 3, further comprising:

said first and said second foldable end panels being folded such that said second foldable end panel extends inward to press against the wound paper and to rub against an exterior surface of the paper core, and said third and said fourth foldable end panels being folded such that said fourth foldable end panel extends inward to press against the wound paper and to rub against an exterior surface of the paper core.

6. The corrugated shipping container of claim 1, further comprising:

a tab panel contiguous with a first end panel of said four rectangular main panels, said tab panel being rotatable to a position wherein it is in an overlapping contact with a second end panel when said panels are rotated into a shipping container configuration.

7. A method of supporting a roll of expandable slit sheet paper within a corrugated shipping container, comprising:

1) providing the corrugated shipping container of claim 1; and 2) placing inside the corrugated shipping container a roll of expandable slit sheet paper that is wound on an interior core member, the core member having an axial length that is greater than the width of the slit sheet paper that is wound on said core member;

3) rotating said second foldable end panel about a fold line to a position substantially parallel to both a rectangular main panel and the axis of said core member and positioned to contact with said core member and having an edge of the second foldable panel positioned to contact with said roll of expandable slit paper;

4) rotating said fourth foldable end panel about a fold line to a position substantially parallel to both a rectangular main panel and the axis of said core member and positioned to contact with said core member and having an edge of the fourth foldable end panel positioned to contact with said roll of expandable slit paper.

* * * * *